US010947073B2

(12) United States Patent
Magnusson et al.

(10) Patent No.: US 10,947,073 B2
(45) Date of Patent: Mar. 16, 2021

(54) VELOCITY AND TORQUE BASED MEDIA MOTOR CONTROL

(71) Applicant: Hewlett-Packard Development Company, L.P., Spring, TX (US)

(72) Inventors: Daniel James Magnusson, Vancouver, WA (US); Ian Patrick Anderson, Vancouver, WA (US); Joseph C O'Banion, Vancouver, WA (US); Devin Scott Uehling, Vancouver, WA (US); Alan Shibata, Vancouver, WA (US); Saurabh Shripad Bhide, Vancouver, WA (US); Stuart Scofield, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/651,197

(22) PCT Filed: Oct. 3, 2017

(86) PCT No.: PCT/US2017/054971
§ 371 (c)(1),
(2) Date: Mar. 26, 2020

(87) PCT Pub. No.: WO2019/070245
PCT Pub. Date: Apr. 11, 2019

(65) Prior Publication Data

US 2020/0270081 A1 Aug. 27, 2020

(51) Int. Cl.
*B65H 5/06* (2006.01)
*B41J 11/14* (2006.01)
(Continued)

(52) U.S. Cl.
CPC ..... *B65H 5/06* (2013.01); *B41J 11/14* (2013.01); *B41J 13/03* (2013.01); *B41J 11/42* (2013.01);
(Continued)

(58) Field of Classification Search
CPC ..... B65H 5/06; B65H 5/062; B65H 2513/10; B65H 2513/102; B65H 2515/32;
(Continued)

(56) References Cited

U.S. PATENT DOCUMENTS 5,751,331 A 5/1998 Higuchi
6,176,410 B1 1/2001 Ueda et al.
(Continued)

OTHER PUBLICATIONS

Allen-Bradley~ 1336 Impact Ac Drive, Aug. 1, 2011, http://www.efesotomasyon.com/ 8 pages.

*Primary Examiner* — Jeremy R Severson
(74) *Attorney, Agent, or Firm* — Mannava & Kang

(57) ABSTRACT

In some examples, velocity and torque based media motor control may include ascertaining a velocity and torque for a feed roller motor associated with a feed roller, and ascertaining a velocity and torque for a drive roller motor associated with a drive roller that is to receive media from the feed roller. Further, velocity and torque based media motor control may include determining whether the torque for the drive roller motor is greater than a torque target. In response to a determination that the torque for the drive roller motor is greater than the torque target, the torque for the drive roller motor may be reduced to the torque target, and the torque for the drive roller motor may be maintained at the torque target.

15 Claims, 13 Drawing Sheets

(51) Int. Cl.
*B41J 13/03* (2006.01)
*B41J 11/42* (2006.01)

(52) U.S. Cl.
CPC .... *B65H 2513/106* (2013.01); *B65H 2515/32* (2013.01)

(58) Field of Classification Search
CPC ..... B65H 2513/106; B41J 11/42; B41J 13/03; B41J 11/14
See application file for complete search history.

(56) References Cited

U.S. PATENT DOCUMENTS

| | | | | |
|---|---|---|---|---|
| 6,607,321 | B2 * | 8/2003 | Markham | B41J 11/42 271/270 |
| 7,481,506 | B2 * | 1/2009 | Saito | B41J 29/38 347/16 |
| 8,020,864 | B1 | 9/2011 | Tharayil et al. | |
| 8,152,166 | B2 | 4/2012 | Krucinski | |
| 9,499,639 | B2 | 11/2016 | Charles et al. | |
| 2006/0214965 | A1 | 9/2006 | Saito | |
| 2009/0136281 | A1 | 5/2009 | Fernandez | |
| 2013/0070014 | A1 | 3/2013 | Iesaki | |

* cited by examiner 110
122
120
A
B
Media
(paper)
Velocity
Torque
Velocity
Torque
Held constant
Allowed to vary
500
502
Feed Motor Velocity
Feed Motor Torque
Drive Motor Velocity
Drive Motor Torque
Velocity A
Torque A
Velocity B
Torque B
x10^5
x10^4
x10^4
45
45.5
46
46.5
47
47.5
48
48.5
49

VELOCITY AND TORQUE BASED MEDIA MOTOR CONTROL

BACKGROUND

In a printing system, media may be fed from a source via a feed roller to a destination via a drive roller that receives the media from the feed roller. The source may include an input tray. The destination may include an output tray or another intermediate location along a print path. The media may include paper. The feed roller and the drive roller may be respectively operated by feed roller and drive roller motors.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
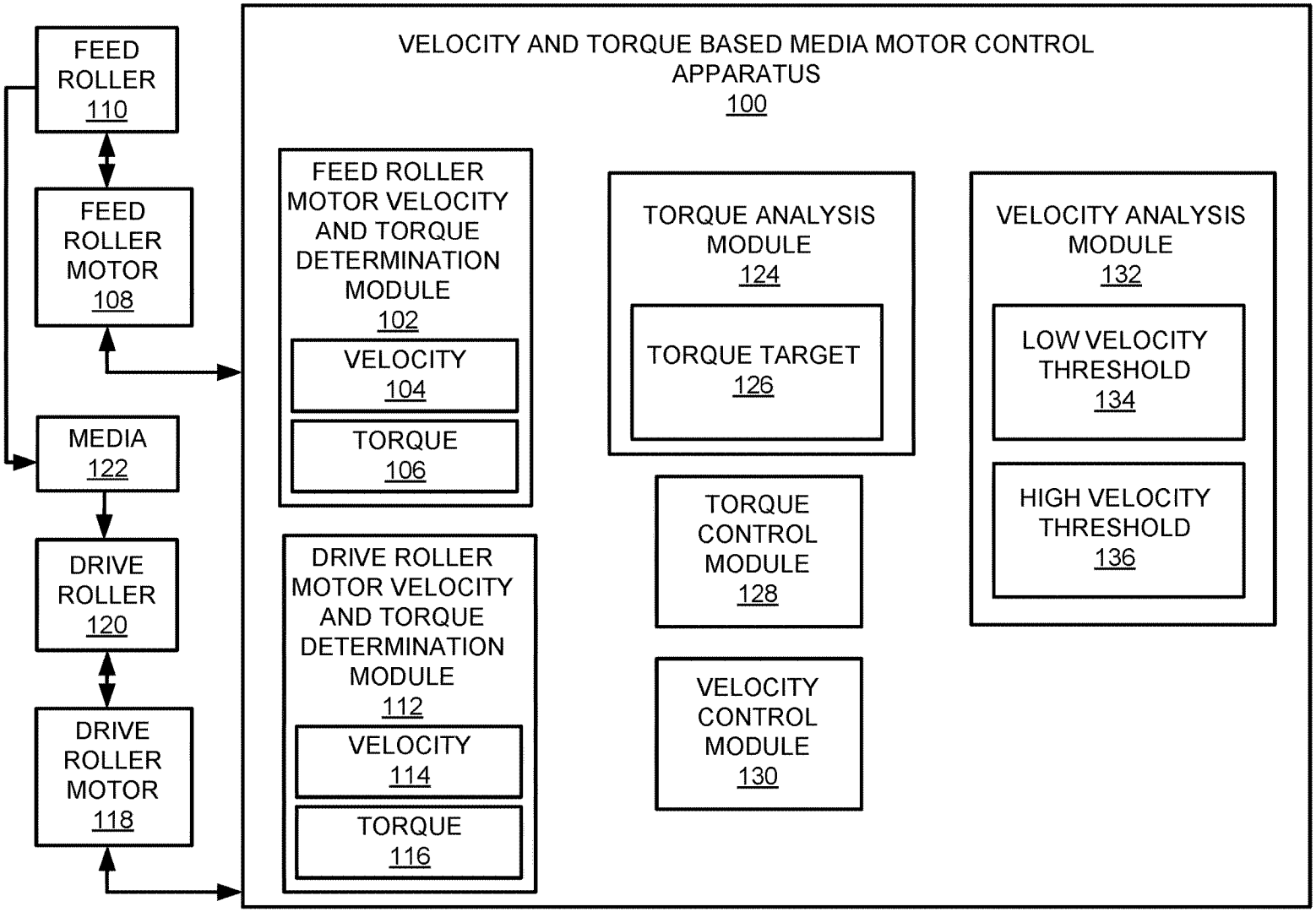
FIG. 1 illustrates an example layout of a velocity and torque based media motor control apparatus.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Velocity and torque based media motor control apparatuses, methods for velocity and torque based media motor control, and non-transitory computer readable media having stored thereon machine readable instructions to provide velocity and torque based media motor control are disclosed herein. The apparatuses, methods, and non-transitory computer readable media disclosed herein provide for dynamic control of media motors depending, for example, on location of media, and/or operational velocity and/or torque associated with the media motors.

With respect to media motor control, in a printing system, media may be fed from a source via a feed roller to a destination via a drive roller that receives the media from the feed roller. The feed roller and the drive roller may be respectively operated by feed roller and drive roller motors. As the media is being fed from the feed roller to the drive roller, it is technically challenging to control the tension imparted on the media by the drive roller which may operate at a higher rotational velocity compared to the feed roller.

In order to address at least these technical challenges with respect to media motor control, the apparatuses, methods, and non-transitory computer readable media disclosed herein provide for control of the feed roller and drive roller motors to impart different tension values on the media depending on the operational velocity and torque of the feed roller and drive roller motors. For example, as media is being fed from the feed roller to the drive roller, a determination is made as to whether the torque for the drive roller motor is greater than a torque target. In response to a determination that the torque for the drive roller motor is greater than the torque target, the torque for the drive roller motor may be reduced to the torque target. Thus, for the feed and drive roller motors, the torque for the drive roller motor may be dynamically controlled in response to a determination that the torque for the drive roller motor is greater than the torque target. Further, the torque for the drive roller motor may be maintained at the torque target, and variations in the velocity for the drive roller motor may be allowed during the maintenance of the torque for the drive roller motor at the torque target. In this manner, the torque for the drive roller motor may be dynamically controlled based on an analysis of the torque for the drive roller motor relative to the torque target, and the velocity for the drive roller motor may also be controlled as disclosed herein.

For the apparatuses, methods, and non-transitory computer readable media disclosed herein, modules, as described herein, may be any combination of hardware and programming to implement the functionalities of the respective modules. In some examples described herein, the combinations of hardware and programming may be implemented in a number of different ways. For example, the programming for the modules may be processor executable instructions stored on a non-transitory machine-readable storage medium and the hardware for the modules may include a processing resource to execute those instructions. In these examples, a computing device implementing such modules may include the machine-readable storage medium storing the instructions and the processing resource to execute the instructions, or the machine-readable storage medium may be separately stored and accessible by the computing device and the processing resource. In some examples, some modules may be implemented in circuitry.

FIG. 1 illustrates an example layout of a velocity and torque based media motor control apparatus (hereinafter also referred to as "apparatus 100").

Referring to FIG. 1, the apparatus 100 may include a feed roller motor velocity and torque determination module 102 to ascertain a velocity 104 and a torque 106 for a feed roller motor 108 associated with (i.e., imparts motion of) a feed roller 110. In this regard, as illustrated in FIGS. 3-10, the feed roller 110 may include an upper roller and a lower roller in the orientation FIGS. 3-10.

A drive roller motor velocity and torque determination module 112 is to ascertain a velocity 114 and a torque 116 for a drive roller motor 118 associated with (i.e., imparts motion of) a drive roller 120 that is to receive media 122 from the feed roller 110. In this regard, as illustrated in FIGS. 3-10, the drive roller 120 may include an upper roller and a lower roller in the orientation FIGS. 3-10.

According to an example, the media 122 may include paper.

According to an example, the ascertained velocity 114 for the drive roller motor 118 associated with the drive roller 120 may be greater than the ascertained velocity 104 for the feed roller motor 108 associated with the feed roller 110. That is, the velocity 114 for the drive roller motor 118 associated with the drive roller 120 may be set to be greater than the velocity 104 for the feed roller motor 108 associated with the feed roller 110.

According to an example, the drive roller motor velocity and torque determination module 112 is to ascertain, after a specified acceleration distance of the drive roller motor 118, the velocity 114 and torque 116 for the drive roller motor 118 associated with the drive roller 120 that is to receive the media 122 from the feed roller 110.

A torque analysis module 124 is to determine whether the torque 116 for the drive roller motor 118 is greater than a torque target 126.

In response to a determination that the torque 116 for the drive roller motor 118 is greater than the torque target 126, a torque control module 128 is to reduce the torque 116 for the drive roller motor 118 to the torque target 126. Further, the torque control module 128 is to maintain the torque 116 (e.g., the reduced torque 116) for the drive roller motor 118 at the torque target 126.

A velocity control module 130 is to allow, during the maintenance of the torque 116 for the drive roller motor 118 at the torque target 126, variations in the velocity 114 for the drive roller motor 118.

A velocity analysis module 132 is to determine whether the velocity 114 for the drive roller motor 118 associated with the drive roller 120 is less than a low velocity threshold 134. In response to a determination that the velocity 114 for the drive roller motor 118 associated with the drive roller 120 is less than the low velocity threshold 134, the velocity control module 130 is to generate an indication of stalling of the drive roller motor 118.

The velocity analysis module 132 is to further determine whether the velocity 114 for the drive roller motor 118 associated with the drive roller 120 is greater than a high velocity threshold 136. In response to a determination that the velocity 114 for the drive roller motor 118 associated with the drive roller 120 is greater than the high velocity threshold 136, the velocity control module 130 is to reduce the velocity 114 for the drive roller motor 118 to the high velocity threshold 136. Further, the velocity control module 130 is to maintain (e.g., after the reduction) the velocity 114 for the drive roller motor 118 at the high velocity threshold 136. Further, the torque control module 128 is to allow, during the maintenance of the velocity 114 for the drive roller motor 118 at the high velocity threshold 136, variations in the torque 116 for the drive roller motor 118.

Figure 2:
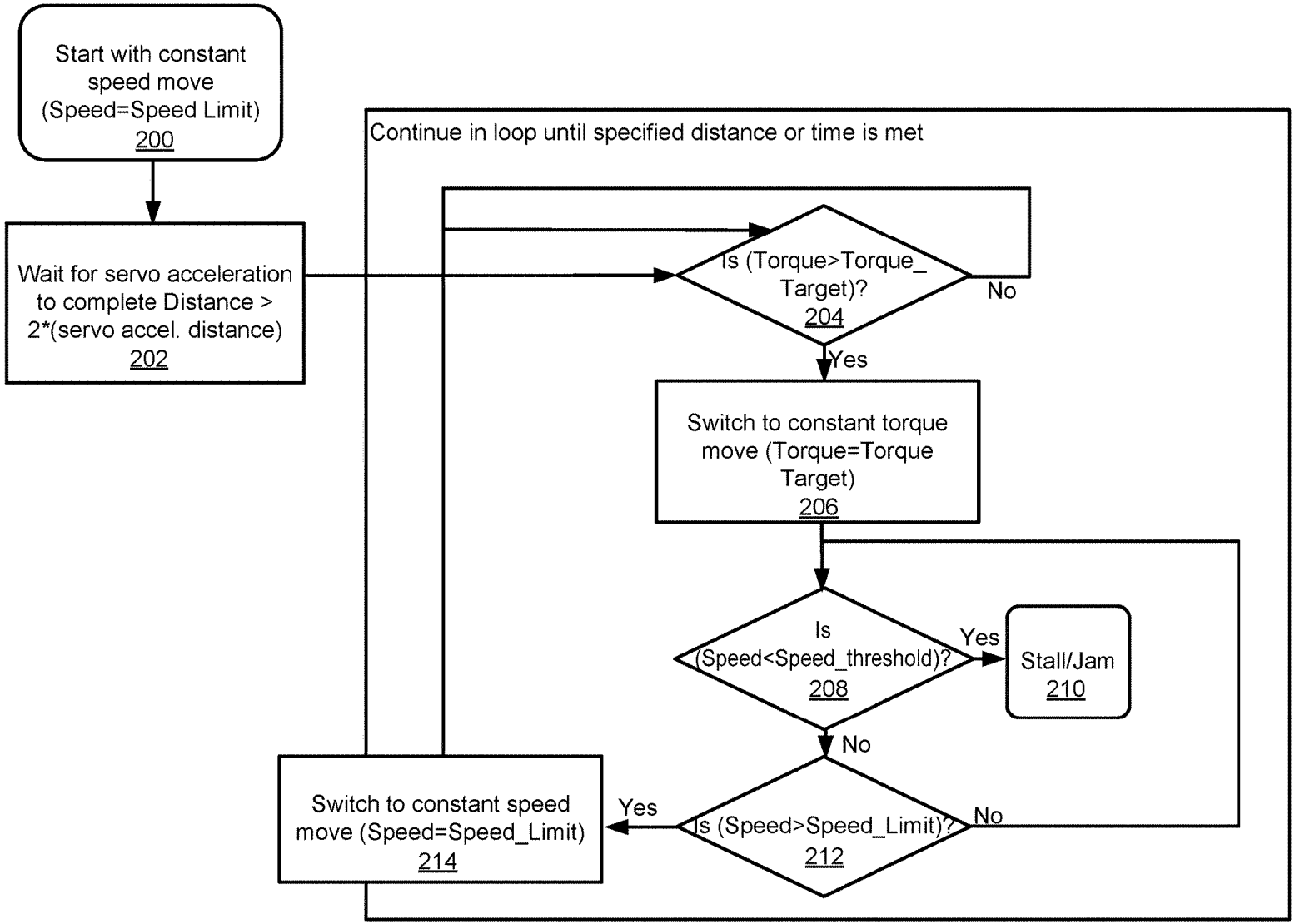
FIG. 2 illustrates a flowchart to illustrate operation of the velocity and torque based media motor control apparatus of FIG. 1.

FIG. 2 illustrates a flowchart to illustrate operation of the apparatus 100.

Referring to FIG. 2, at block 200, the drive roller motor 118 may impart a constant velocity 114 on the drive roller 120. According to an example, the constant velocity 114 may be set at the high velocity threshold 136 (e.g., speed=speed limit).

At block 202, the drive roller motor velocity and torque determination module 112 is to ascertain the velocity 114 and the torque 116 for the drive roller motor 118 associated with the drive roller 120 that is to receive the media 122 from the feed roller 110. In this regard, the drive roller motor velocity and torque determination module 112 is to ascertain, after a specified acceleration distance of the drive roller motor 118, the velocity 114 and the torque 116 for the drive roller motor 118 associated with the drive roller 120 that is to receive the media 122 from the feed roller 110.

At block 204, the torque analysis module 124 is to determine whether the torque 116 for the drive roller motor 118 is greater than the torque target 126.

At block 206, in response to a determination that the torque 116 for the drive roller motor 118 is greater than the torque target 126, the torque control module 128 is to reduce the torque 116 for the drive roller motor 118 to the torque target 126. Further, the torque control module 128 is to maintain the torque 116 for the drive roller motor 118 at the torque target 126.

At block 208, the velocity analysis module 132 is to determine whether the velocity 114 for the drive roller motor 118 associated with the drive roller 120 is less than the low velocity threshold 134.

At block 210, in response to a determination that the velocity 114 for the drive roller motor 118 associated with the drive roller 120 is less than the low velocity threshold 134, the velocity control module 130 is to generate an indication of stalling of the drive roller motor 118.

At block 212, the velocity analysis module 132 is to determine whether the velocity 114 for the drive roller motor 118 associated with the drive roller 120 is greater than the high velocity threshold 136.

At block 214, in response to a determination that the velocity 114 for the drive roller motor 118 associated with the drive roller 120 is greater than the high velocity threshold 136, the velocity control module 130 is to reduce the velocity 114 for the drive roller motor 118 to the high velocity threshold 136. Further, the velocity control module 130 is to maintain the velocity 114 for the drive roller motor 118 at the high velocity threshold 136. Further, the torque control module 128 is to allow, during the maintenance of the velocity 114 for the drive roller motor 118 at the high velocity threshold 136, variations in the torque 116 for the drive roller motor 118.

Figure 3:
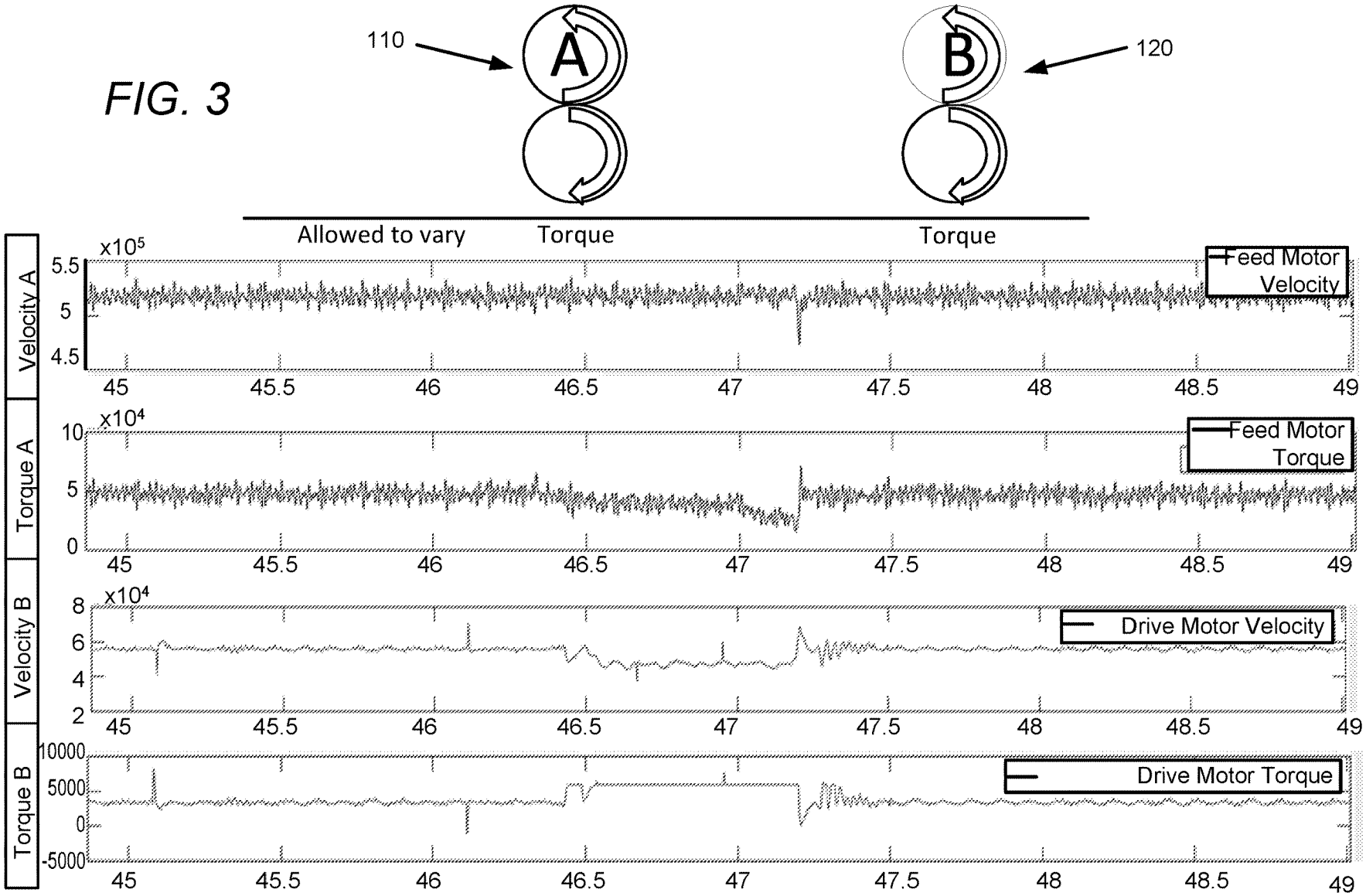
FIG. 3 illustrates torque and velocity with respect to a feed roller motor associated with a feed roller and a drive roller motor associated with a drive roller at start-up to illustrate operation of the velocity and torque based media motor control apparatus of FIG. 1.

FIG. 3 illustrates torque and velocity with respect to a feed roller motor associated with a feed roller and a drive roller motor associated with a drive roller at start-up to illustrate operation of the apparatus 100. The graphs of FIGS. 3-10 illustrate torque and velocity with respect to the feed roller motor associated with the feed roller and the drive roller motor associated with the drive roller with respect to the entire cycle of the flowchart of FIG. 2 to illustrate operation of the apparatus 100.

Referring to FIG. 3, the feed roller motor 108 may impart the velocity 104 on the feed roller 110. Similarly, the drive roller motor 118 may impart the constant velocity 114 on the drive roller 120. In this regard, the feed roller motor 108 and the drive roller motor 118 may start from rest, and torque may be respectively applied to the feed roller 110 and the drive roller 120 to turn (e.g., rotate) the feed roller 110 and the drive roller 120.

Figure 4:
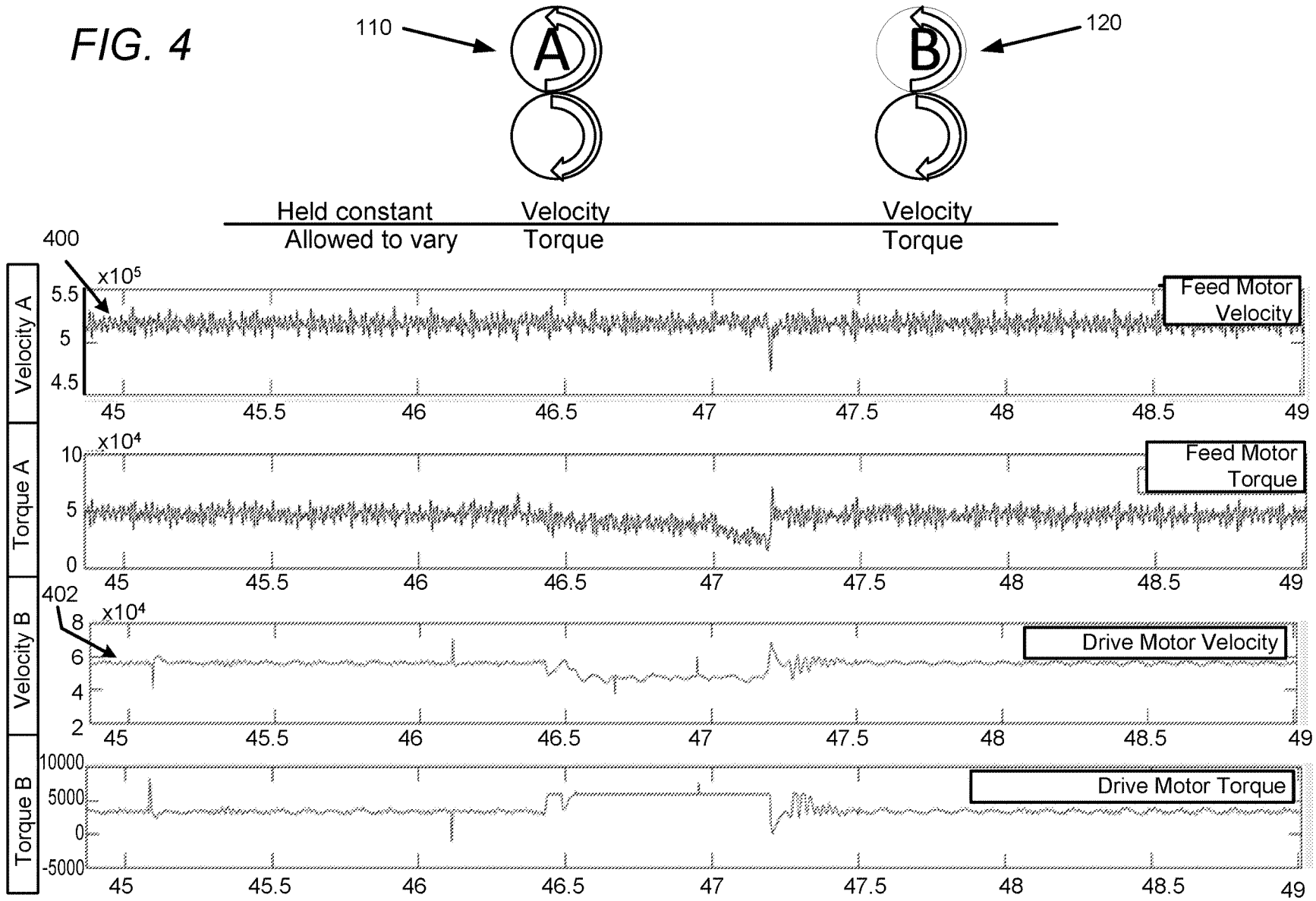
FIG. 4 illustrates torque and velocity with respect to the feed roller motor associated with the feed roller and the drive roller motor associated with the drive roller at steady state velocity with no media to illustrate operation of the velocity and torque based media motor control apparatus of FIG. 1.

FIG. 4 illustrates torque and velocity with respect to the feed roller motor associated with the feed roller and the drive roller motor associated with the drive roller at steady state velocity with no media to illustrate operation of the apparatus 100.

Referring to FIGS. 4, at 400 and 402 respectively, the feed roller motor 108 and the drive roller motor 118 may be at steady state velocity, with the drive roller motor 118 being operated at a faster velocity compared to the feed roller motor 108 to impart the faster velocity on the feed roller 110 compared to the drive roller 120.

Figure 5:
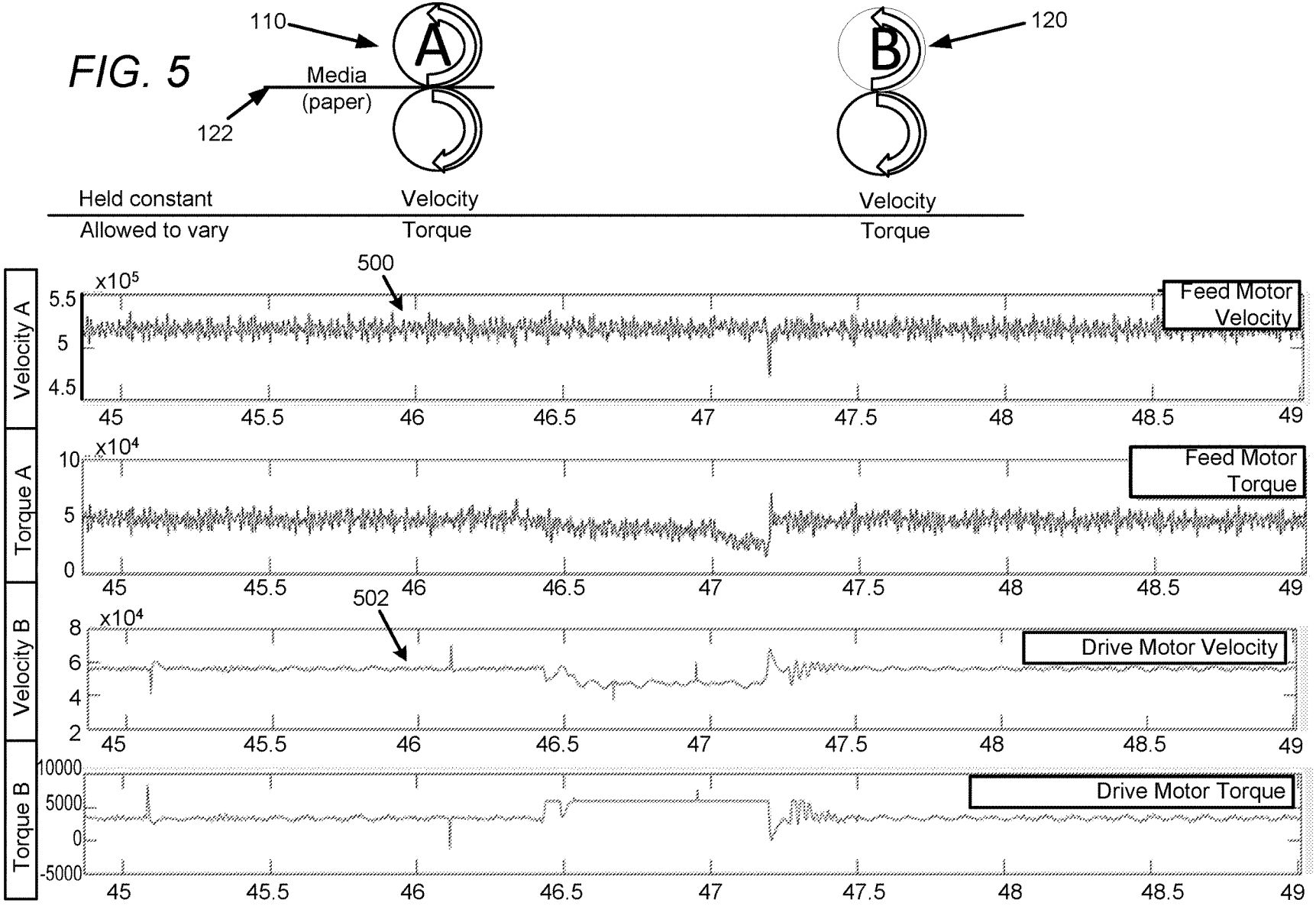
FIG. 5 illustrates torque and velocity with respect to the feed roller motor associated with the feed roller and the drive roller motor associated with the drive roller as media enters the feed roller to illustrate operation of the velocity and torque based media motor control apparatus of FIG. 1.

FIG. 5 illustrates torque and velocity with respect to the feed roller motor associated with the feed roller and the drive roller motor associated with the drive roller as media enters the feed roller to illustrate operation of the apparatus 100.

Referring to FIGS. 5, at 500 and 502 respectively, as the media 122 enters the feed roller 110, the velocity and torque of the feed roller motor 108 imparted on the feed roller 110 and the drive roller motor 118 imparted on the drive roller 120 may remain constant.

Figure 6:
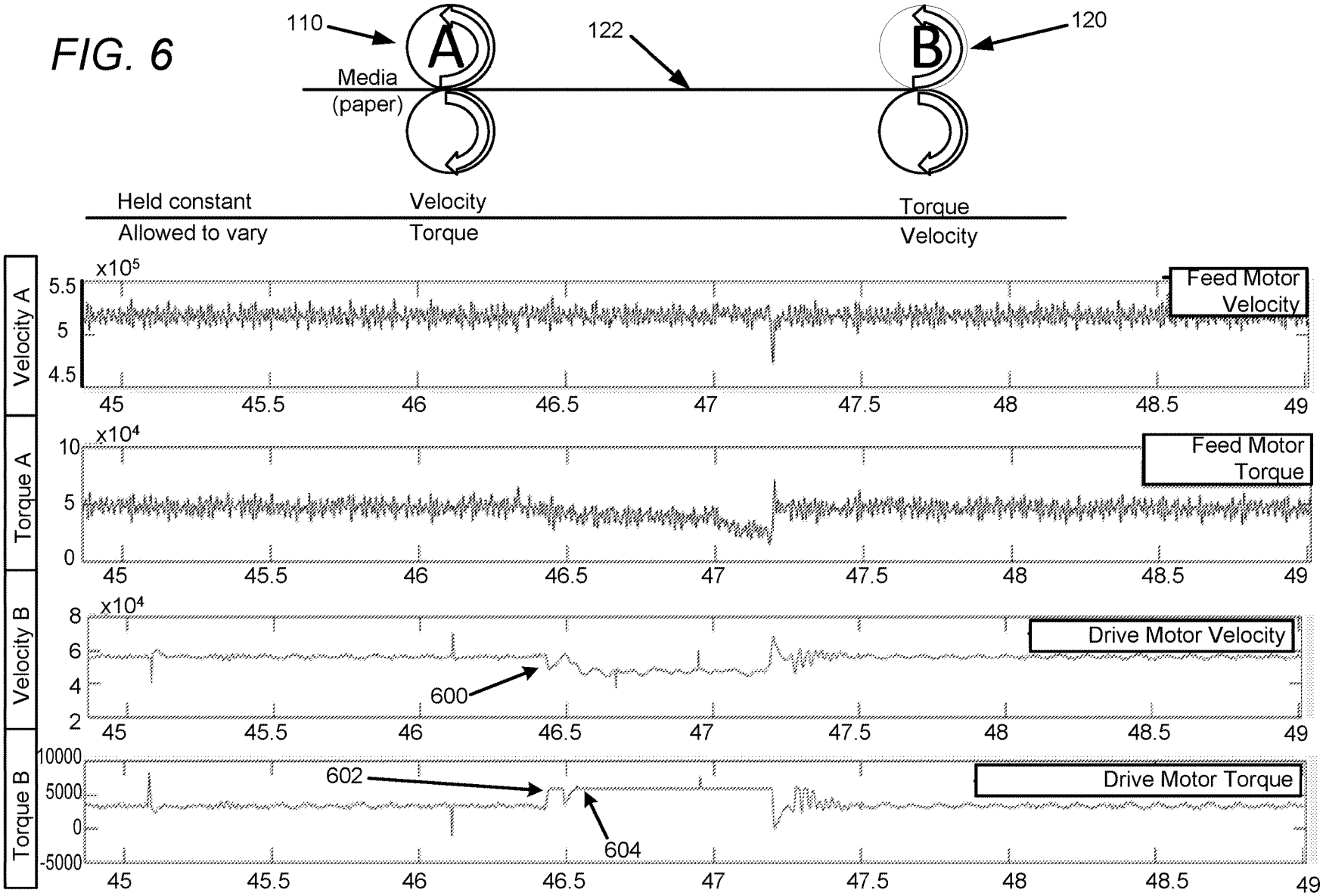
FIG. 6 illustrates torque and velocity with respect to the feed roller motor associated with the feed roller and the drive roller motor associated with the drive roller as media enters the drive roller from the feed roller to illustrate operation of the velocity and torque based media motor control apparatus of FIG. 1.

FIG. 6 illustrates torque and velocity with respect to the feed roller motor associated with the feed roller and the drive roller motor associated with the drive roller as media enters the drive roller from the feed roller to illustrate operation of the apparatus 100.

Referring to FIG. 6, at 600, as the media 122 enters the drive roller 120 from the feed roller 110, the velocity at of the drive roller motor 118 with respect to the drive roller 120 may decrease. At 602, as the media 122 enters the drive roller 120 from the feed roller 110, the torque at of the drive roller motor 118 with respect to the drive roller 120 may increase. Further, at 604, the torque control module 128 may maintain the torque 116 for the drive roller motor 118 at the torque target 126.

Figure 7:
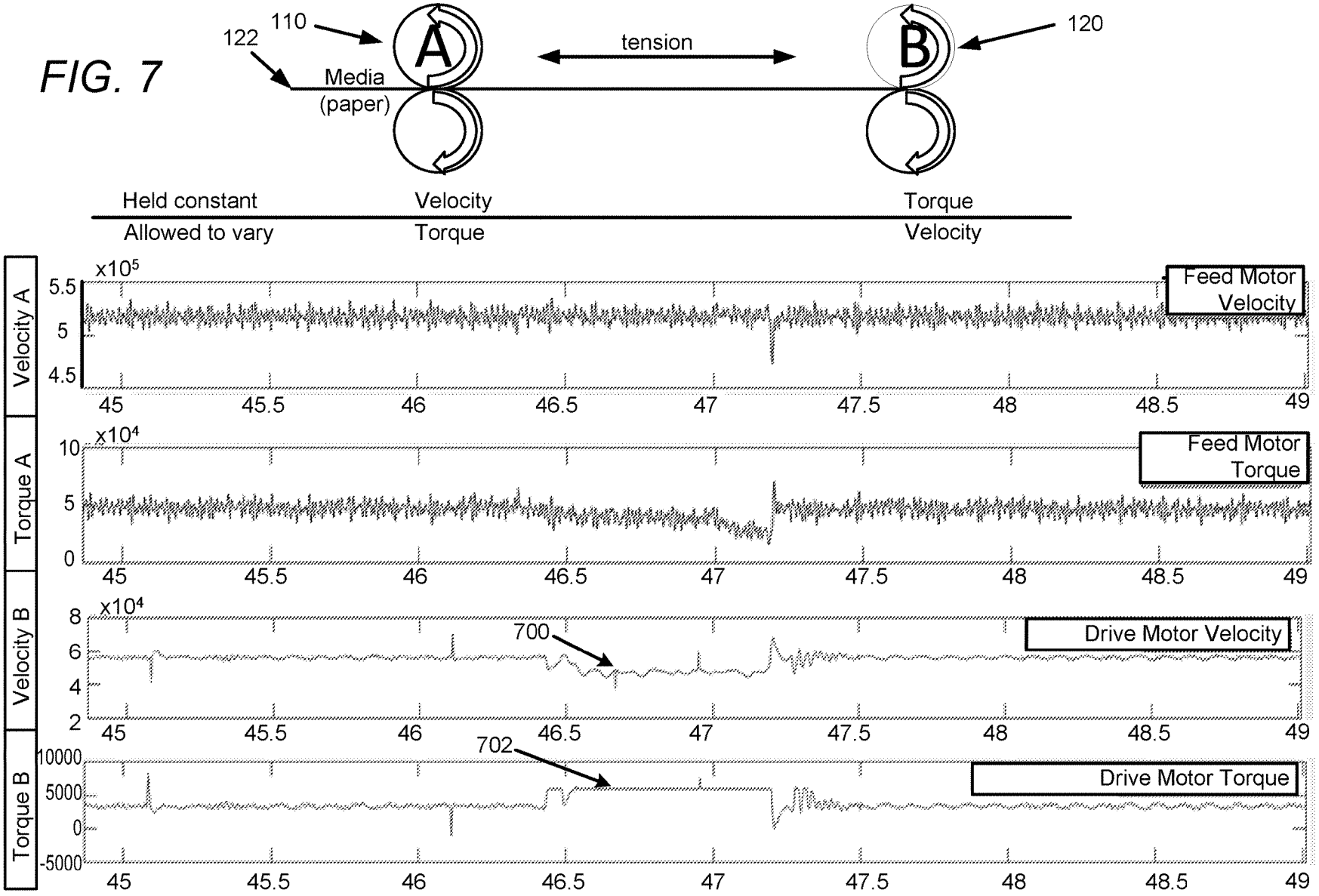
FIG. 7 illustrates torque and velocity with respect to the feed roller motor associated with the feed roller and the drive roller motor associated with the drive roller as media is tensioned between the drive roller and the feed roller to illustrate operation of the velocity and torque based media motor control apparatus of FIG. 1.

FIG. 7 illustrates torque and velocity with respect to the feed roller motor associated with the feed roller and the drive roller motor associated with the drive roller as media is tensioned between the drive roller and the feed roller to illustrate operation of the apparatus 100.

Referring to FIG. 7, at 700, as the media 122 is tensioned between the drive roller 120 and the feed roller 110, the velocity control module 130 may allow, during the maintenance of the torque 116 for the drive roller motor 118 at the torque target 126, variations in the velocity 114 for the drive roller motor 118. Further, at 702, the torque 116 may be held constant to maintain a constant tension in the media 122.

Figure 8:
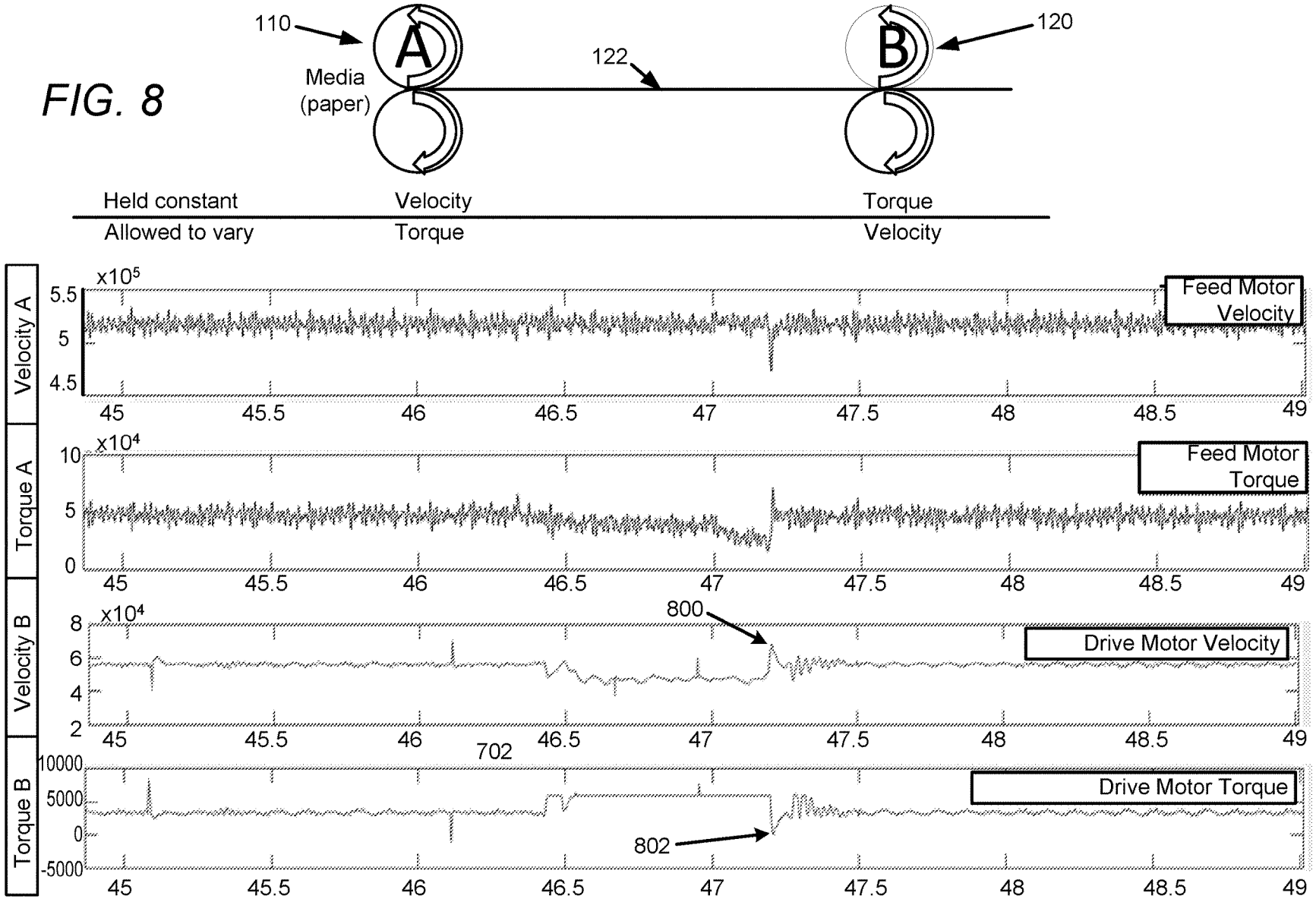
FIG. 8 illustrates torque and velocity with respect to the feed roller motor associated with the feed roller and the drive roller motor associated with the drive roller as media begins to leave the feed roller to illustrate operation of the velocity and torque based media motor control apparatus of FIG. 1.

FIG. 8 illustrates torque and velocity with respect to the feed roller motor associated with the feed roller and the drive roller motor associated with the drive roller as media begins to leave the feed roller to illustrate operation of the apparatus 100.

Referring to FIG. 8, at 800, as the media 122 begins to leave the feed roller 110, the velocity 114 may increase beyond the high velocity threshold 136. Further, at 802, the torque 116 may decrease as the media 122 is no longer in tension.

Figure 9:
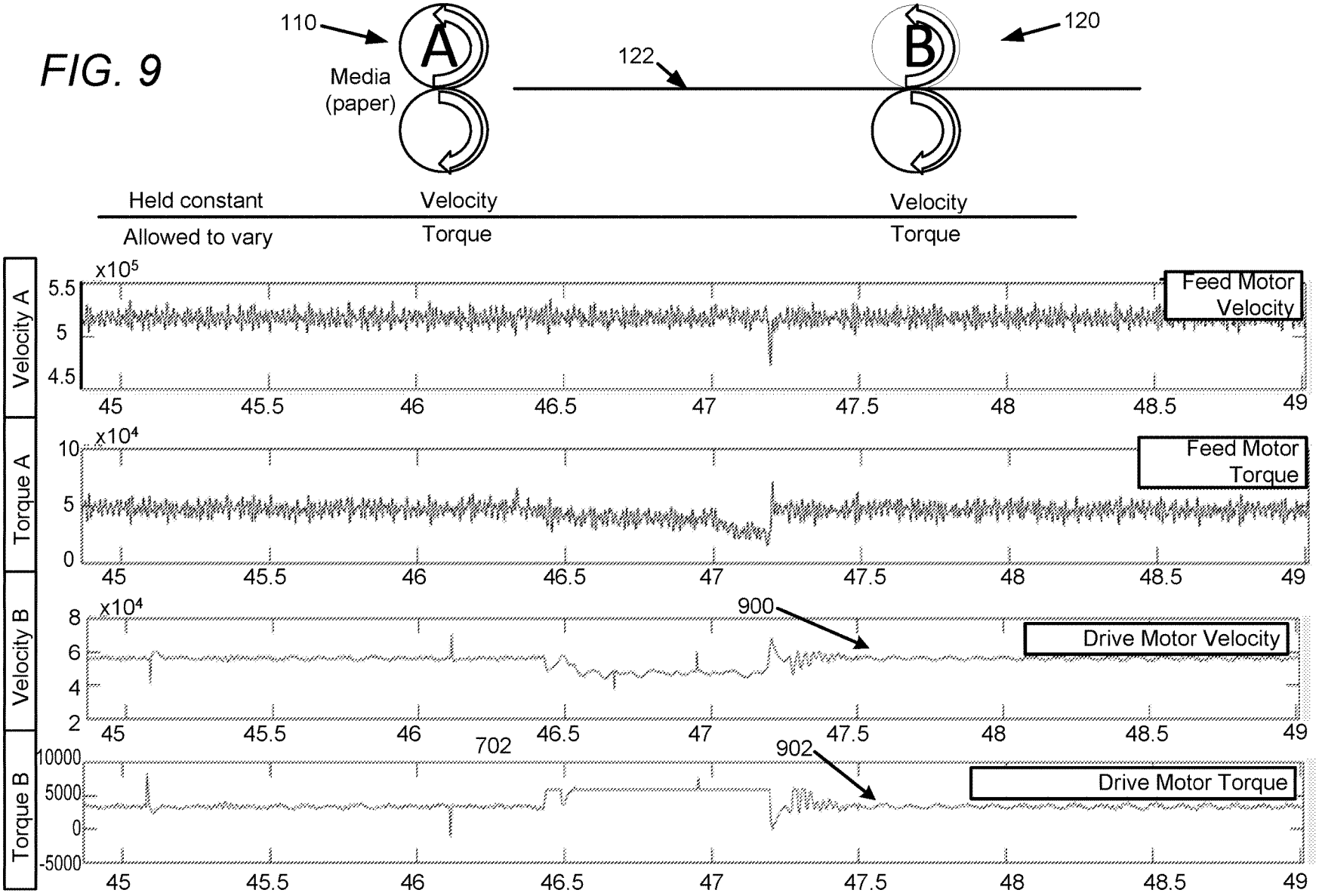
FIG. 9 illustrates torque and velocity with respect to the feed roller motor associated with the feed roller and the drive roller motor associated with the drive roller as media leaves the feed roller to illustrate operation of the velocity and torque based media motor control apparatus of FIG. 1.

FIG. 9 illustrates torque and velocity with respect to the feed roller motor associated with the feed roller and the drive roller motor associated with the drive roller as media leaves the feed roller to illustrate operation of the apparatus 100.

Referring to FIG. 9, at 900, as the media 122 leaves the feed roller 110, the drive roller 120 may be placed in constant velocity mode. That is, the velocity control module 130 may reduce the velocity 114 for the drive roller motor 118 to the high velocity threshold 136. Further, the velocity control module 130 may maintain the velocity 114 for the drive roller motor 118 at the high velocity threshold 136. At 902, the torque control module 128 may allow, during the maintenance of the velocity 114 for the drive roller motor 118 at the high velocity threshold 136, variations in the torque 116 for the drive roller motor 118.

Figure 10:
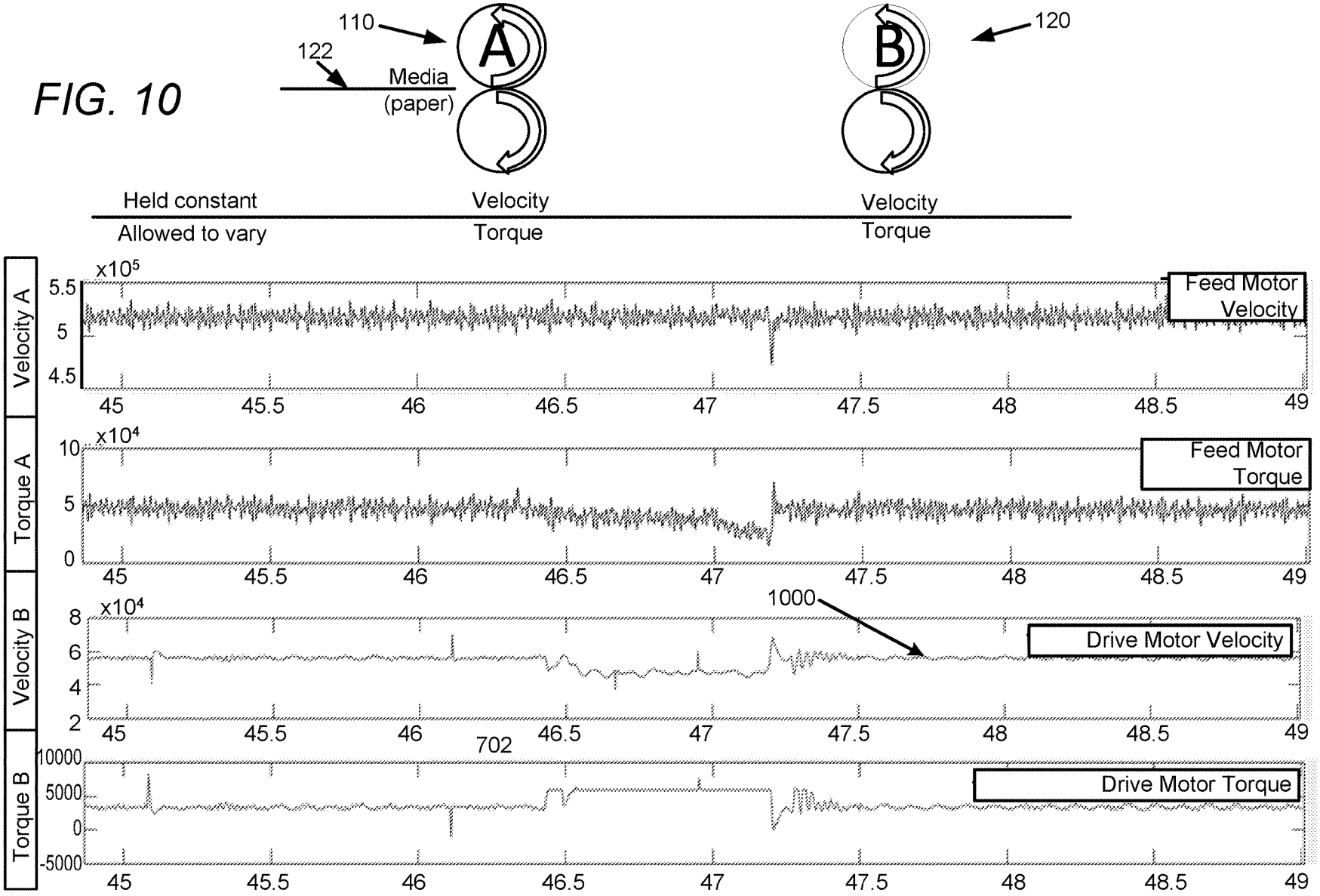
FIG. 10 illustrates torque and velocity with respect to the feed roller motor associated with the feed roller and the drive roller motor associated with the drive roller at constant velocity before further media enters the feed roller to illustrate operation of the velocity and torque based media motor control apparatus of FIG. 1.

FIG. 10 illustrates torque and velocity with respect to the feed roller motor associated with the feed roller and the drive roller motor associated with the drive roller at constant velocity before further media enters the feed roller to illustrate operation of the apparatus 100.

Referring to FIG. 10, at 1000, the drive roller 120 may operate at constant velocity (e.g., at the high velocity threshold 136) before further media 122 enters the feed roller 110.

Figure 11:
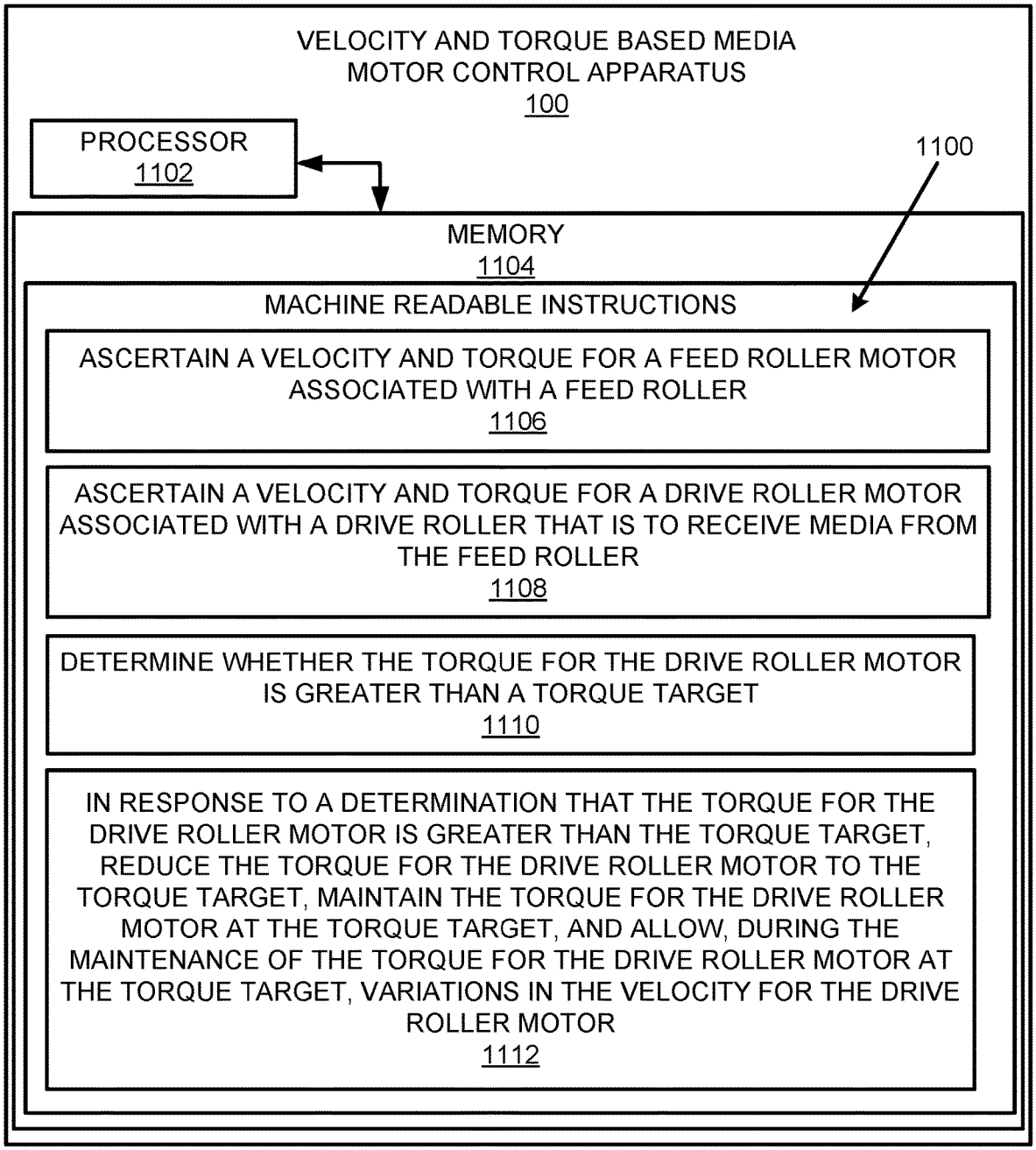
FIG. 11 illustrates an example block diagram for velocity and torque based media motor control.
Figure 12:
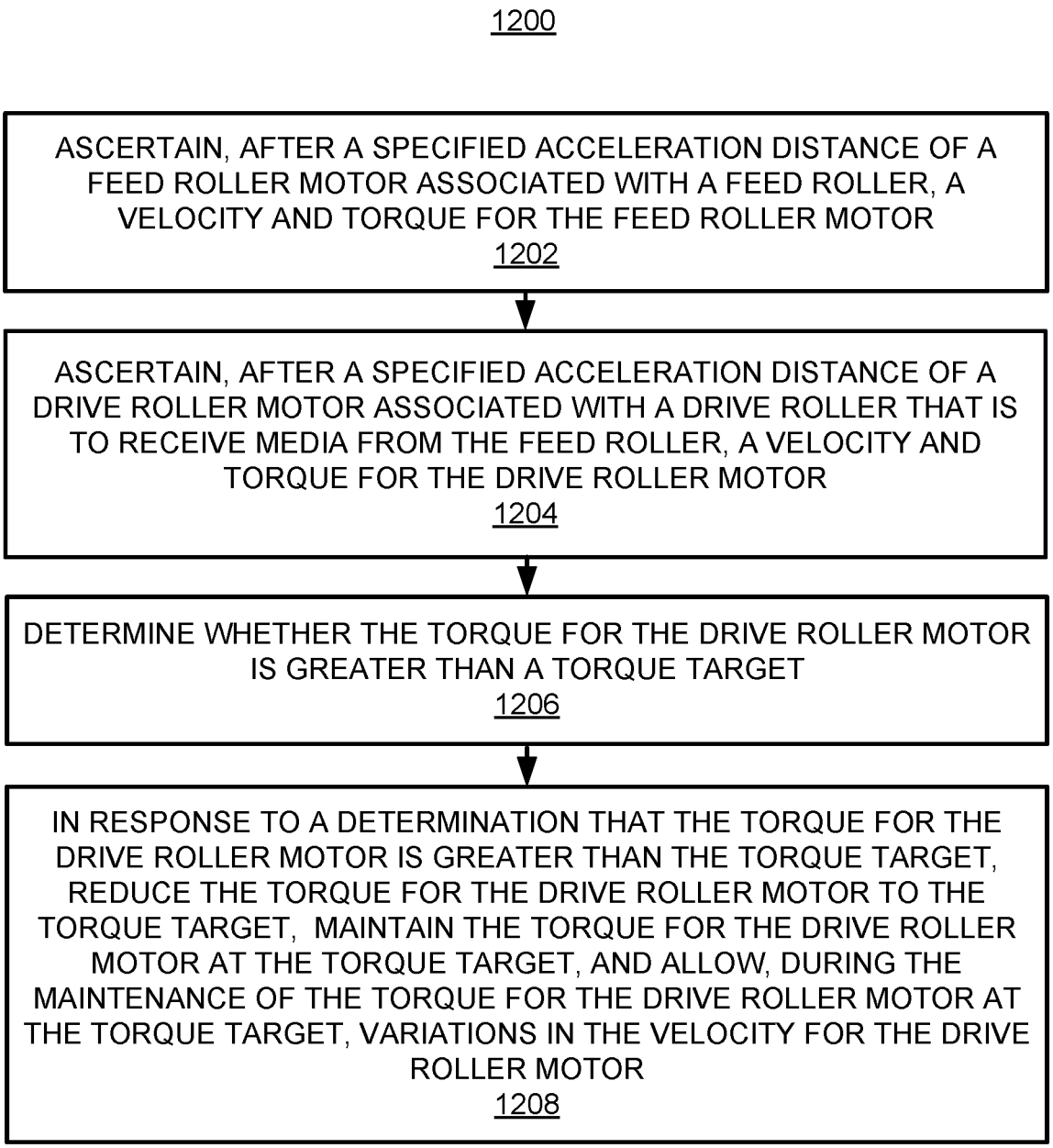
FIG. 12 illustrates an example flowchart of a method for velocity and torque based media motor control.
Figure 13:
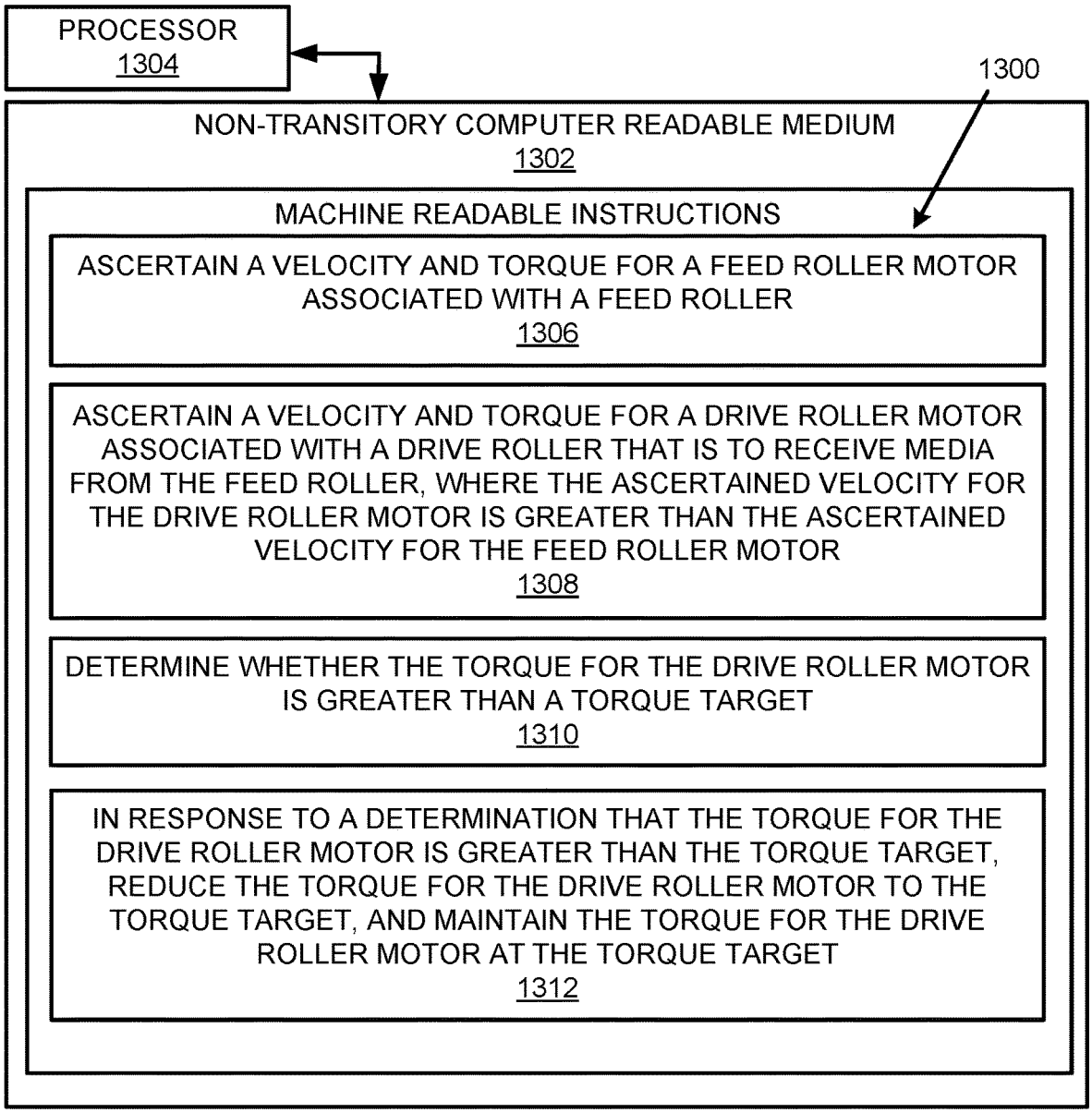
FIG. 13 illustrates a further example block diagram for velocity and torque based media motor control.

FIGS. 11-13 respectively illustrate an example block diagram 1100, an example flowchart of a method 1200, and a further example block diagram 1300 for velocity and torque based media motor control. The block diagram 1100, the method 1200, and the block diagram 1300 may be implemented on the apparatus 100 described above with reference to FIG. 1 by way of example and not limitation. The block diagram 1100, the method 1200, and the block diagram 1300 may be practiced in other apparatus. In addition to showing the block diagram 1100, FIG. 11 shows hardware of the apparatus 100 that may execute the instructions of the block diagram 1100. The hardware may include a processor 1102, and a memory 1104 (i.e., a non-transitory computer readable medium) storing machine readable instructions that when executed by the processor cause the processor to perform the instructions of the block diagram 1100. The memory 1104 may represent a non-transitory computer readable medium. FIG. 12 may represent a method for velocity and torque based media motor control, and the steps of the method. FIG. 13 may represent a non-transitory computer readable medium 1302 having stored thereon machine readable instructions to provide velocity and torque based media motor control. The machine readable instructions, when executed, cause a processor 1304 to perform the instructions of the block diagram 1300 also shown in FIG. 13.

The processor 1102 of FIG. 11 and/or the processor 1304 of FIG. 13 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 1302 of FIG. 13), such as hardware storage devices (e.g., RAM (random access memory), ROM (read only memory), EPROM (erasable, programmable ROM), EEPROM (electrically erasable, programmable ROM), hard drives, and flash memory). The memory 1104 may include a RAM, where the machine readable instructions and data for a processor may reside during runtime.

Referring to FIGS. 1-11, and particularly to the block diagram 1100 shown in FIG. 11, the memory 1104 may include instructions 1106 to ascertain a velocity 104 and a torque 106 for a feed roller motor 108 associated with (i.e., imparts motion of) a feed roller 110.

The processor 1102 may fetch, decode, and execute the instructions 1108 to ascertain a velocity 114 and a torque 116 for a drive roller motor 118 associated with (i.e., imparts motion of) a drive roller 120 that is to receive media 122 from the feed roller 110.

The processor 1102 may fetch, decode, and execute the instructions 1110 to determine whether the torque 116 for the drive roller motor 118 is greater than a torque target 126.

In response to a determination that the torque 116 for the drive roller motor 118 is greater than the torque target 126, the processor 1102 may fetch, decode, and execute the instructions 1112 to reduce the torque 116 for the drive roller motor 118 to the torque target 126, maintain the torque 116 (e.g., the reduced torque 116) for the drive roller motor 118 at the torque target 126, and allow, during the maintenance of the torque 116 for the drive roller motor 118 at the torque target 126, variations in the velocity 114 for the drive roller motor 118.

Referring to FIGS. 1-10 and 12, and particularly FIG. 12, for the method 1200, at block 1202, the method may include ascertaining, after a specified acceleration distance of a feed roller motor 108 associated with a feed roller 110, a velocity and torque for the feed roller motor 108.

At block 1204 the method may include ascertaining, after a specified acceleration distance of a drive roller motor 118 associated with a drive roller 120 that is to receive media 122 from the feed roller 110, a velocity and torque for the drive roller motor 118.

At block 1206 the method may include determining whether the torque 116 for the drive roller motor 118 is greater than a torque target 126.

In response to a determination that the torque 116 for the drive roller motor 118 is greater than the torque target 126, at block 1208 the method may include reducing the torque 116 for the drive roller motor 118 to the torque target 126, maintaining the torque 116 for the drive roller motor 118 at the torque target 126, and allowing, during the maintenance of the torque 116 for the drive roller motor 118 at the torque target 126, variations in the velocity 114 for the drive roller motor 118.

Referring to FIGS. 1-10 and 13, and particularly FIG. 13, for the block diagram 1300, the non-transitory computer readable medium 1302 may include instructions 1306 to ascertain a velocity 104 and a torque 106 for a feed roller motor 108 associated with (i.e., imparts motion of) a feed roller 110.

The processor 1304 may fetch, decode, and execute the instructions 1308 to ascertain a velocity and torque for a drive roller motor 118 associated with a drive roller 120 that is to receive media 122 from the feed roller 110, where the ascertained velocity 114 for the drive roller motor 118 is greater than the ascertained velocity 104 for the feed roller motor 108.

The processor 1304 may fetch, decode, and execute the instructions 1310 to determine whether the torque 116 for the drive roller motor 118 is greater than a torque target 126.

In response to a determination that the torque 116 for the drive roller motor 118 is greater than the torque target 126, the processor 1304 may fetch, decode, and execute the instructions 1312 to reduce the torque 116 for the drive roller motor 118 to the torque target 126, and maintain the torque 116 for the drive roller motor 118 at the torque target 126.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. An apparatus comprising:

a processor; and a non-transitory computer readable medium storing machine readable instructions that when executed by the processor cause the processor to:

ascertain a velocity and torque for a feed roller motor associated with a feed roller;

ascertain a velocity and torque for a drive roller motor associated with a drive roller that is to receive media from the feed roller;

determine whether the torque for the drive roller motor is greater than a torque target; and in response to a determination that the torque for the drive roller motor is greater than the torque target, reduce the torque for the drive roller motor to the torque target, maintain the torque for the drive roller motor at the torque target, and allow, during the maintenance of the torque for the drive roller motor at the torque target, variations in the velocity for the drive roller motor.

2. The apparatus according to claim 1, wherein the media includes paper.

3. The apparatus according to claim 1, wherein the instructions are further to cause the processor to:

ascertain, after a specified acceleration distance of the drive roller motor, the velocity and torque for the drive roller motor associated with the drive roller that is to receive media from the feed roller.

4. The apparatus according to claim 1, wherein the instructions are further to cause the processor to:

determine whether the velocity for the drive roller motor associated with the drive roller is less than a low velocity threshold; and in response to a determination that the velocity for the drive roller motor associated with the drive roller is less than the low velocity threshold, generate an indication of stalling of the drive roller motor.

5. The apparatus according to claim 4, wherein the instructions are further to cause the processor to:

determine whether the velocity for the drive roller motor associated with the drive roller is greater than a high velocity threshold; and in response to a determination that the velocity for the drive roller motor associated with the drive roller is greater than the high velocity threshold, reduce the velocity for the drive roller motor to the high velocity threshold, maintain the velocity for the drive roller motor at the high velocity threshold, and allow, during the maintenance of the velocity for the drive roller motor at the high velocity threshold, variations in the torque for the drive roller motor.

6. The apparatus according to claim 1, wherein the ascertained velocity for the drive roller motor associated with the drive roller is greater than the ascertained velocity for the feed roller motor associated with the feed roller.

7. A computer implemented method comprising:

ascertaining, after a specified acceleration distance of a feed roller motor associated with a feed roller, a velocity and torque for the feed roller motor;

ascertaining, after a specified acceleration distance of a drive roller motor associated with a drive roller that is to receive media from the feed roller, a velocity and torque for the drive roller motor;

determining whether the torque for the drive roller motor is greater than a torque target; and in response to a determination that the torque for the drive roller motor is greater than the torque target, reducing the torque for the drive roller motor to the torque target, maintaining the torque for the drive roller motor at the torque target, and allowing, during the maintenance of the torque for the drive roller motor at the torque target, variations in the velocity for the drive roller motor.

8. The method according to claim 7, wherein the media includes paper.

9. The method according to claim 7, further comprising:

determining whether the velocity for the drive roller motor associated with the drive roller is less than a low velocity threshold; and in response to a determination that the velocity for the drive roller motor associated with the drive roller is less than the low velocity threshold, generating an indication of stalling of the drive roller motor.

10. The method according to claim 9, further comprising:

determining whether the velocity for the drive roller motor associated with the drive roller is greater than a high velocity threshold; and in response to a determination that the velocity for the drive roller motor associated with the drive roller is greater than the high velocity threshold, reducing the velocity for the drive roller motor to the high velocity threshold, maintaining the velocity for the drive roller motor at the high velocity threshold, and allowing, during the maintenance of the velocity for the drive roller motor at the high velocity threshold, variations in the torque for the drive roller motor.

11. The method according to claim 7, wherein the ascertained velocity for the drive roller motor associated with the drive roller is greater than the ascertained velocity for the feed roller motor associated with the feed roller.

12. A non-transitory computer readable medium having stored thereon machine readable instructions, the machine readable instructions, when executed, cause a processor to:

ascertain a velocity and torque for a feed roller motor associated with a feed roller;

ascertain a velocity and torque for a drive roller motor associated with a drive roller that is to receive media from the feed roller, wherein the ascertained velocity for the drive roller motor is greater than the ascertained velocity for the feed roller motor;

determine whether the torque for the drive roller motor is greater than a torque target; and in response to a determination that the torque for the drive roller motor is greater than the torque target, reduce the torque for the drive roller motor to the torque target, and maintain the torque for the drive roller motor at the torque target.

13. The non-transitory computer readable medium according to claim 12, wherein the machine readable instructions, when executed, further cause the processor to:

allow, during the maintenance of the torque for the drive roller motor at the torque target, variations in the velocity for the drive roller motor.

14. The non-transitory computer readable medium according to claim 12, wherein the machine readable instructions, when executed, further cause the processor to:

determine whether the velocity for the drive roller motor associated with the drive roller is less than a low velocity threshold; and in response to a determination that the velocity for the drive roller motor associated with the drive roller is less than the low velocity threshold, generate an indication of stalling of the drive roller motor.

15. The non-transitory computer readable medium according to claim 14, wherein the machine readable instructions, when executed, further cause the processor to:

determine whether the velocity for the drive roller motor associated with the drive roller is greater than a high velocity threshold; and in response to a determination that the velocity for the drive roller motor associated with the drive roller is greater than the high velocity threshold, reduce the velocity for the drive roller motor to the high velocity threshold, maintain the velocity for the drive roller motor at the high velocity threshold, and allow, during the maintenance of the velocity for the drive roller motor at the high velocity threshold, variations in the torque for the drive roller motor.

* * * * *